US006659388B2

(12) United States Patent
Frank et al.

(10) Patent No.: US 6,659,388 B2
(45) Date of Patent: Dec. 9, 2003

(54) CONTACT ROLLER SYSTEM OF A WINDING MACHINE FOR THIN STRIP MATERIAL

(75) Inventors: Martin Frank, Wiehl (DE); Dieter Pflitsch, Reichshof (DE)

(73) Assignee: WT Wickeltechnik GmbH, Wiehl (DE)

( * ) Notice: Subject to any disclaimer, the term of this patent is extended or adjusted under 35 U.S.C. 154(b) by 0 days.

(21) Appl. No.: 10/183,217

(22) Filed: Jun. 27, 2002

(65) Prior Publication Data

US 2003/0001043 A1 Jan. 2, 2003

(30) Foreign Application Priority Data

Jun. 28, 2001 (DE) ..... 101 31 364

(51) Int. Cl.[7] ..... B65H 18/10; B65H 18/26
(52) U.S. Cl. ..... 242/530.1; 242/547
(58) Field of Search ..... 242/547, 530.1, 242/530.3, 530.4, 541.5, 541.6

(56) References Cited

U.S. PATENT DOCUMENTS 5,161,747 A * 11/1992 Kramer ..... 242/547
5,806,783 A * 9/1998 Turunen ..... 242/530.1
6,182,919 B1 * 2/2001 Fisher et al. ..... 242/547

* cited by examiner

*Primary Examiner*—John M. Jillions
(74) *Attorney, Agent, or Firm*—Friedrich Kueffner

(57) ABSTRACT

A contact roller system of a winding machine for thin strip material has a shaft and pivot levers arranged in a row adjacent to one another on the shaft. The pivot levers have two contact roller segments moveable against slit rolls during a winding process by an actuating drive of the pivot levers. The two contact rollers are arranged on opposite sides of the pivot levers, respectively, and form a contact roller segment pair positioned adjacent to one another such that between neighboring end faces a gap required for rotational movement of the contact roller segment pairs is formed. The contact roller segment pairs are freely rotatably supported and rotate about an axis of rotation extending parallel to the pivot axis of the pivot levers. The axes of rotation of the contact roller segment pairs have a common pivot radius.

10 Claims, 4 Drawing Sheets

CONTACT ROLLER SYSTEM OF A WINDING MACHINE FOR THIN STRIP MATERIAL

BACKGROUND OF THE INVENTION

1. Field of the Invention

The invention relates to a contact roller system of a winding machine for thin strip material, in particular, a slitter rewinder for longitudinally slitting thin materials into individual strips and winding the individual strips onto slit rolls. The system comprises contact roller segments which are moved against the slit rolls during the winding process by means of a drive and are supported end face to end face adjacent to one another so as to be freely rotatable.

2. Description of the Related Art

The contact roller segments of a known contact roller system of this kind disclosed in German patent application 198 05 412 A1 for a winding machine for winding thin strip material are provided in order to prevent as much as possible the introduction of air into wound material of the slits rolls, in particular, at high winding speeds, and to ensure proper winding of the strip material in this way.

The contact position and the contact pressure of each contact roller segment of the contact roller system are individually adjustable in order to compensate unavoidable diameter differences of the strip rolls. Each contact roller segment is freely rotatably supported at its end faces on two lateral bearing plates which are fastened on a carriage arranged on a transverse beam and movable by means of a linear drive perpendicularly to the axis of rotation of the slit roll toward and away from the slit roll.

In order to keep the gap between two neighboring contact roller segments as small as possible so as to prevent markings on the wound strip material, in the known contact roller system the lateral bearing plates of two neighboring contact roller segments are arranged alternatingly above and below the axis of rotation of the roller segments perpendicularly to the movement direction thereof during advancing against the slit rolls.

The configuration of this known contact roller system is complex because for supporting each contact roller segment two bearing plates with two axle supports must be provided. A further disadvantage of the contact roller system is to be seen in that the control of the contact position of the contact roller segments, which changes constantly as a result of the changing winding diameter of the slit rolls, operates imprecisely based on a linear movement of the roller segments.

SUMMARY OF THE INVENTION

It is an object of the present invention to improve a contact roller system of a winding machine for thin strip material of the aforementioned kind with respect to its configuration and the control of the contact position of the contact roller segments.

In accordance with the present invention, this is achieved by providing pivot levers, arranged on a shaft in a row adjacent to one another and provided with an actuating drive as well as with two contact roller segments on opposite sides of the pivot levers, which contact roller segments are freely rotatably supported on an axis of rotation parallel to the pivot axis of the pivot levers, wherein the axes of rotation of the contact roller segment pairs have a common pivot radius and wherein a gap required for the rotational movement of the roller segments is formed between two neighboring contact roller segments, respectively.

By furnishing the contact roller system according to the invention with pivot levers, arranged on a common rotary shaft in a row adjacent to one another and provided with an actuating drive, the pivot levers having on opposed sides two contact roller segments that are supported on axle supports so as to be freely rotatable on an axis of rotation that is parallel to the pivot axis of the pivot levers, a constructive simplification relative to the contact roller system according to the prior art is realized. The system according to the invention enables an optimal control of the contact position of the individual contact roller segments on the slit rolls during winding of thin material strips.

DESCRIPTION OF THE PREFERRED EMBODIMENTS

Figure 1:
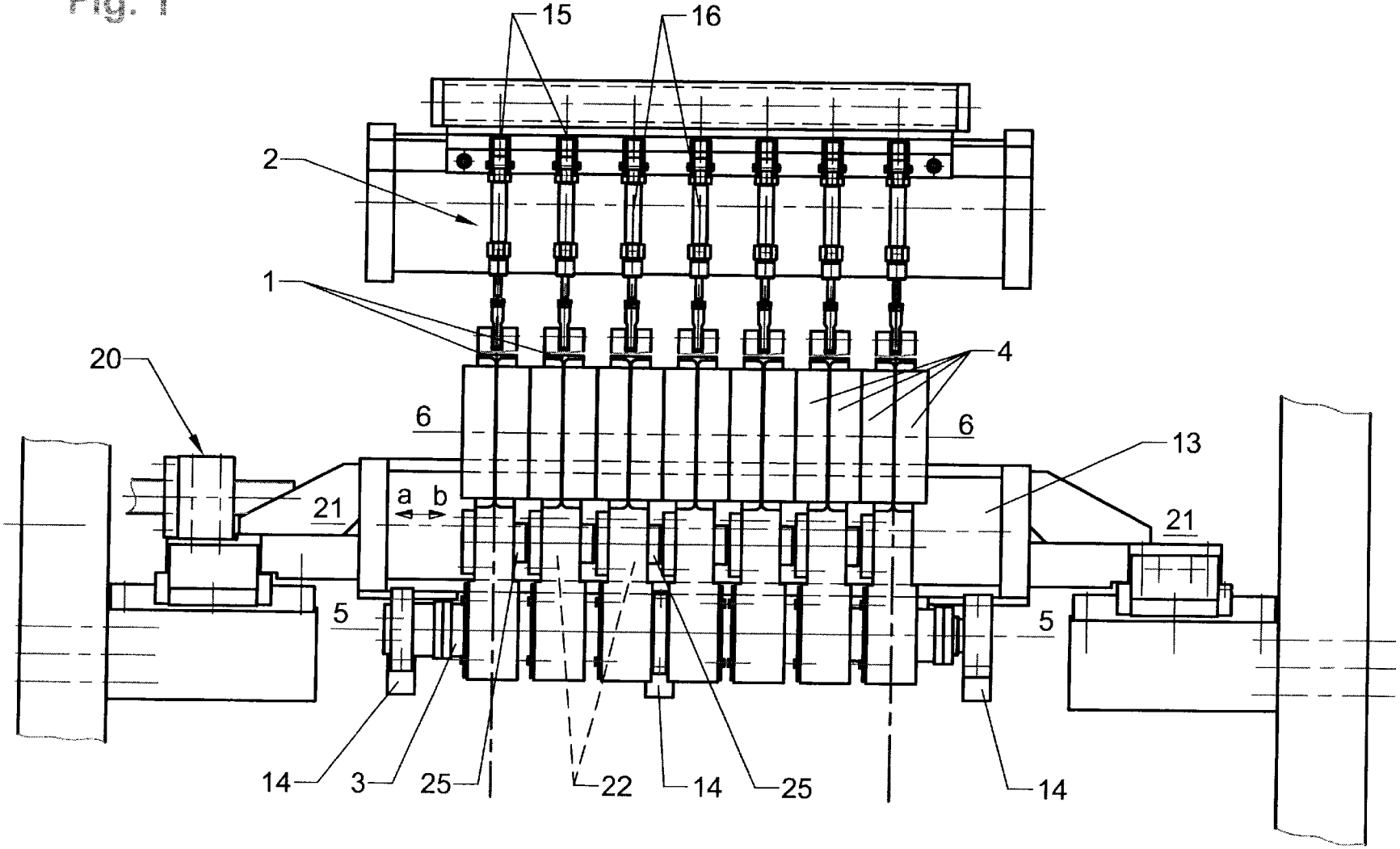
FIG. 1 shows a front view of the contact roller system according to the invention, wherein the actuating devices for the individual pivot levers of the contact roller segments are illustrated in a position rotated by 90° out of the horizontal mounting position into a vertical position.
Figure 2:
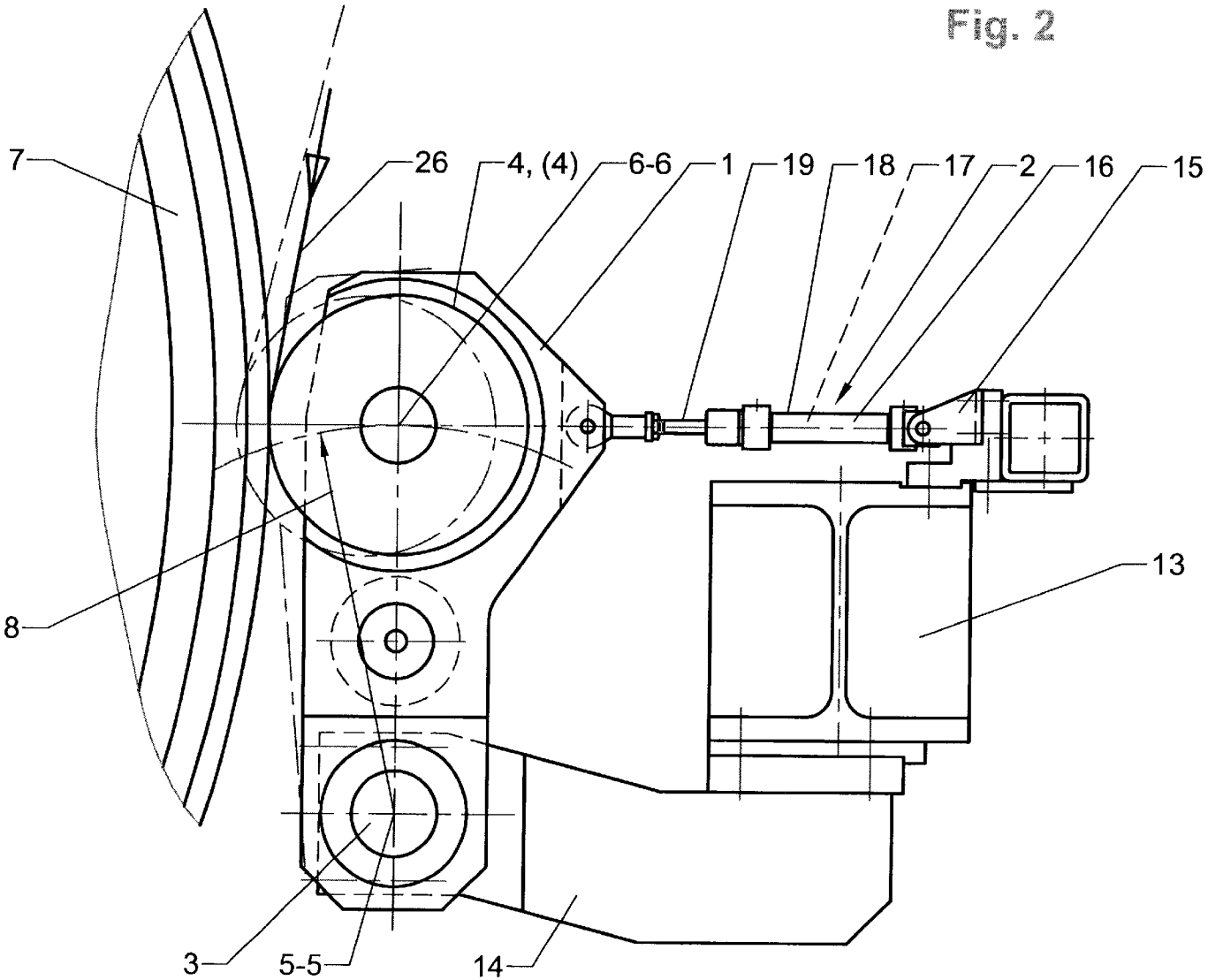
FIG. 2 is a side view of the contact roller system on an enlarged scale.
Figure 3:
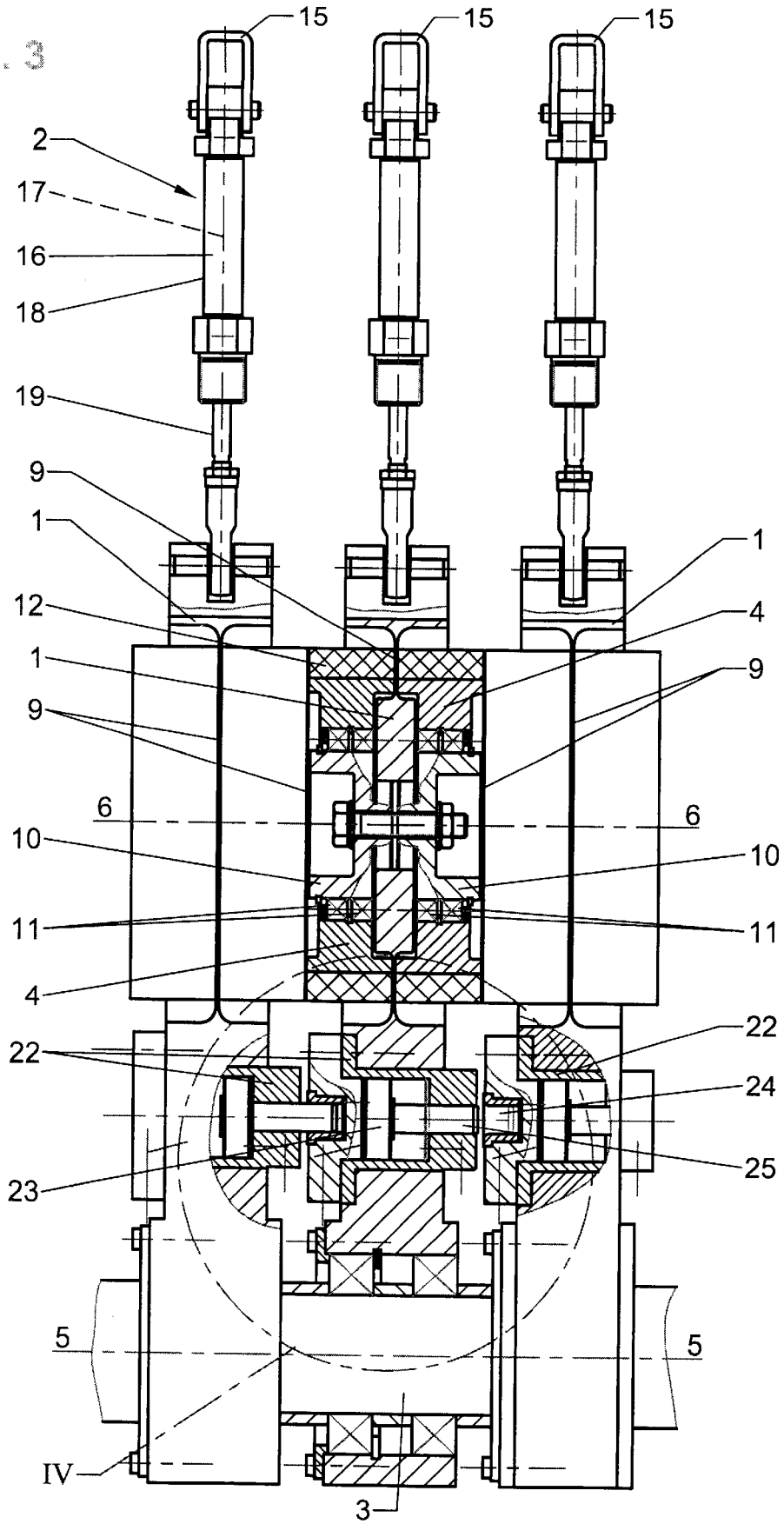
FIG. 3 shows an enlarged longitudinal section of a pivot lever with two contact roller segments, wherein the actuating device of the pivot lever is illustrated in a position rotated by 90°, as in FIG. 1.
Figure 4:
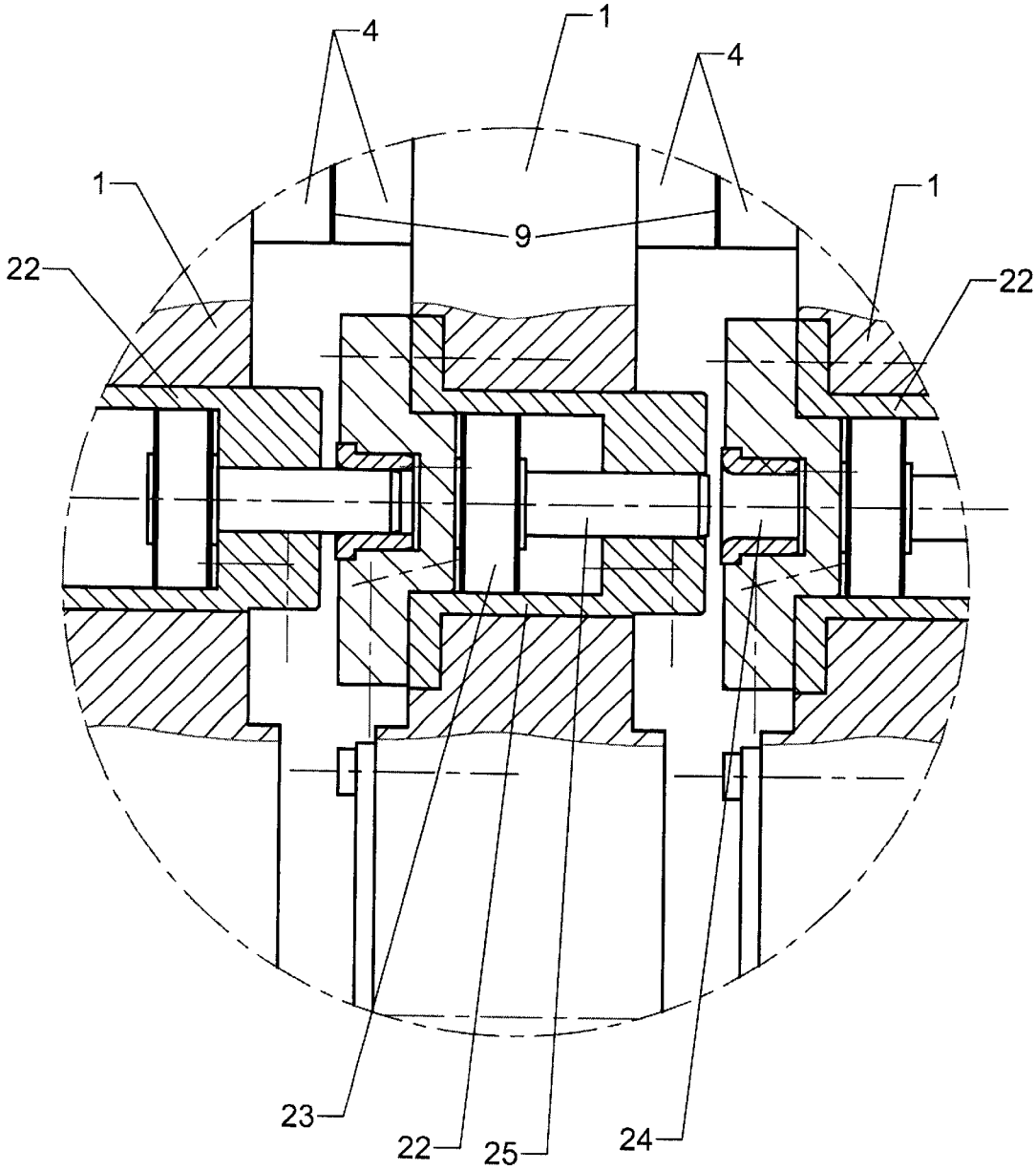
FIG. 4 shows an enlarged illustration of a coupling of two pivot levers according to the detail IV of FIG. 3.

Preferably, slitter rewinders for longitudinal slitting of a material into individual strips and winding of the individual strips onto slip rolls are provided with the contact roller system according to FIGS. 1 through 4.

The contact roller system comprises several pivot levers 1 provided with an actuating device 2 and arranged in a row adjacent to one another on a common shaft 3. On the opposing sides of each pivot lever 1 two contact roller segments 4 are freely rotatably supported on an axis of rotation 6—6 extending parallel to the pivot axis 5—5 of the pivot levers 1. The axis of rotation 6—6 of the contact roller segment pairs 4, 4, movable by means of the pivot levers 1 against the slit rolls 7, have a common pivot radius 8, and between two adjacent contact roller segments 4 a minimal gap 9 is formed which is required for the rotational movement of the roller segments 4.

Two axle supports 10 are connected by screwing to both opposite sides of the pivot levers 1 on which the contact roller segments 4 are rotatably supported by means of ball bearings 11. An outer running layer or coating 12 of rubber is applied to the contact roller segments 4.

Instead of the axle supports 10 for the contact roller segments 4 being connected by screwing to the pivot levers 1, the axle supports can be formed as a monolithic part of the pivot lever, respectively.

The contact roller system has a double-T shaped transverse beam 13 provided with three support arms 14 for a rotatable or stationary support of the shaft 3 of the pivot levers 1 and further provided with fixed pivot brackets 15 for pneumatic cylinders 16 with an actuating piston 17 provided for moving the pivot levers 1 with the contact roller segments 4 against the slit rolls 7.

The housing 18 of each pneumatic cylinder 16 is pivotably connected to one of the fixed pivot brackets 15 provided on the transverse beam 13 and the piston rod 19 of the actuating piston 17 of the pneumatic cylinder 16 is pivotably connected to a pivot lever 1 supporting a contact roller segment pair 4, 4.

The transverse beam 13 with the pivot levers 1 and the contact roller segments 4 rotatably supported thereon is movable back and forth in the direction of its longitudinal axis 21—21, parallel to the axes 5—5 and 6—6, by a linear drive 20, for example, an electromechanical actuator, so that the contact roller segments 4 can be aligned relative to the slit rolls 7 and the contact roller segments 4 can perform a traversing movement.

Pneumatic cylinders 22 with an actuating piston 23 are inserted into the pivot levers 1. The piston 23 is movable parallel to the pivot axis 5—5 of the pivot levers 1. On the actuating piston 23 a locking bolt 25 is provided which can be inserted into a corresponding receiving bore 24 of the neighboring pivot lever 1 for a rigid coupling of two neighboring contact roller segments pairs 4, 4; 4, 4.

The pivot levers 1, which are actuated by the actuating devices 2, and have the contact roller segments 4 freely rotatably supported on both sides thereof, respectively, enable a very precise control of the contact position of the contact roller segments 4 on a slit roll 7, which contact position is always changing during winding, as well as a very precise control of the contact pressure of the contact roller segments.

When changing the strip width of the strips 26, neighboring contact roller segments 4 can be coupled by computer control for forming a rigid contact roller whose width is greater than the width of the strip to be wound.

In the case of very sensitive materials, for example, aluminum foil of a thickness of less than 10 $\mu$, even very small gaps 9 between two neighboring contact roller segments 4 can lead to annular markings on a slit roll 7. For preventing such markings, the transverse beam 13 of the contact roller system is subjected to a traversing movement together with the pivot levers 1 and the contact roller segments 4, which are freely rotatably supported thereon, this traversing movement being carried out in a direction of the arrows a, b transverse to the running direction of the strip 26 to be wound. In this way, the position of the gaps 9 between two neighboring contact roller segments 4 is constantly changed.

While specific embodiments of the invention have been shown and described in detail to illustrate the inventive principles, it will be understood that the invention may be embodied otherwise without departing from such principles.

What is claimed is:

1. A contact roller system of a winding machine for thin strip material, the contact roller system comprising:

a shaft;

pivot levers arranged in a row adjacent to one another on the shaft;

the pivot levers having an actuating drive, respectively, configured to pivot the pivot levers about a pivot axis;

the pivot levers having two contact roller segments, respectively, wherein the contact roller segments are moveable against slit rolls during a winding process by the pivot levers;

wherein the two contact roller segments are arranged on opposite sides of the pivot levers, respectively, and form a contact roller segment pair;

wherein the contact roller segment pairs are positioned adjacent to one another such that a gap, required for a rotational movement of the contact roller segment pairs, is formed between end faces of the contact roller segment pairs neighboring one another;

wherein the contact roller segment pairs are freely rotatably supported and rotate about an axis of rotation parallel to the pivot axis of the pivot levers; and wherein the axes of rotation of the contact roller segment pairs have a common pivot radius.

2. The contact roller system according to claim 1, wherein the pivot levers have axle supports for the contact roller segments screwed onto on the opposite sides of the pivot levers, respectively.

3. The contact roller system according to claim 1, wherein the pivot levers comprises axle supports for the contact roller segment pairs, wherein the axle supports are formed as monolithic parts of the pivot levers on the opposite sides of the pivot levers.

4. The contact roller system according to claim 1, further comprising:

a transverse beam with at least two support arms configured to rotatably or stationarily support the shaft of the pivot levers;

fixed pivot brackets connected to the transverse beam;

wherein the actuating drives each comprise a pressure medium cylinder with an actuating piston for moving the pivot levers with the contact roller segments against the slit rolls, wherein the pressure medium cylinders are connected to the fixed pivot bracket, respectively.

5. The contact roller system according to claim 4, wherein the pressure medium cylinder is a pneumatic cylinder.

6. The contact roller system according to claim 4, wherein the pressure medium cylinders have a housing connected to the fixed pivot brackets and a piston rod connected to the pivot levers, respectively.

7. The contact roller system according to claim 4, wherein the transverse beam, together with the pivot levers and the contact roller segments rotatably supported on the pivot levers, is configured to be moved back and forth in a longitudinal direction of the transverse beam by a linear drive in a direction parallel to the axis of rotation of the contact roller segments for alignment of the contact roller segments relative to the slit rolls and for performing a traversing movement of the contact roller segments.

8. The contact roller system according to claim 1, wherein the pivot levers have an integrated coupling for rigidly connecting neighboring ones of the contact roller segment pairs.

9. The contact roller system according to claim 8, wherein the coupling is comprised of a pressure medium cylinder inserted into the pivot levers, respectively, wherein the pressure medium cylinder comprises an actuating piston movable parallel to the pivot axis of the pivot levers and having a locking bolt connected thereto, wherein the coupling further comprises a matching receiving bore for the locking bolt arranged in a neighboring one of the pivot levers.

10. The contact roller system according to claim 1, wherein the winding machine is a slitter rewinder for longitudinal slitting of materials into individual strips and winding the individual strips to slit rolls.

* * * * *